US005551179A

United States Patent [19]

Young

[11] Patent Number: 5,551,179

[45] Date of Patent: Sep. 3, 1996

[54] BOLT CARRIER

[76] Inventor: Daniel H. Young, 4120 Mission La., Phoenix, Ariz. 85051

[21] Appl. No.: 369,388

[22] Filed: Jan. 6, 1995

[51] Int. Cl.[6] ..... F41A 3/12; F41A 3/64

[52] U.S. Cl. ..... 42/16; 89/17

[58] Field of Search ..... 89/19, 20.2, 21, 89/191.01, 191.02, 192, 17; 42/16, 17, 19

[56] References Cited

U.S. PATENT DOCUMENTS

| | | | |
|---|---|---|---|
| 147,945 | 2/1874 | Keene | 42/17 |
| 539,974 | 5/1895 | Canet | 89/21 |
| 604,665 | 5/1898 | Lynch et al. | 89/21 |
| 628,870 | 7/1899 | Tompkins | 89/21 |
| 933,098 | 9/1909 | McClean | 89/191.01 |
| 1,005,263 | 10/1911 | McClean | 89/191.01 |
| 2,820,313 | 1/1958 | Perry et al. | 42/16 |
| 3,003,400 | 10/1961 | Johnson | 89/191 |
| 3,512,449 | 5/1970 | Stoner | 89/169 |
| 3,745,686 | 7/1973 | Koon, Jr. | 42/16 |
| 3,756,119 | 9/1973 | Curtis et al. | 89/33 R |
| 3,771,415 | 11/1973 | Into et al. | 89/16 |
| 3,791,256 | 2/1974 | Curtis et al. | 89/185 |
| 3,979,849 | 9/1976 | Haskins | 42/16 |
| 4,433,610 | 2/1984 | Tatro | 89/148 |
| 4,502,367 | 3/1985 | Sullivan | 89/181 |
| 4,553,469 | 11/1985 | Atchisson | 89/191.02 |
| 4,867,040 | 9/1989 | Barrett | 89/172 |
| 5,272,956 | 12/1993 | Hudson | 89/128 |

FOREIGN PATENT DOCUMENTS

| | | | |
|---|---|---|---|
| 8302153 | 6/1983 | WIPO | 42/16 |

OTHER PUBLICATIONS

The M16A1 Rifle—Operation and Preventative Maintenance 1969, pp. 1–30.

*Primary Examiner*—Stephen M. Johnson

*Attorney, Agent, or Firm*—Richard G. Harrer; Charles E. Cates

[57] ABSTRACT

An improved bolt carrier for a gas operated automatic or semi-automatic firearm of the AR15 or M16 type having a substantial increase in the number and area of lands in the forward end of the bolt carrier. This results in increased accuracy of the firearm and makes the action smoother and more consistent.

7 Claims, 3 Drawing Sheets

BOLT CARRIER

FIELD OF THE INVENTION

This invention relates to gas operated automatic and semi-automatic firearms and more particularly to an improved bolt carrier for use in such firearms.

BACKGROUND OF THE INVENTION

A gas operated automatic or semi-automatic firearm of the standard M16 or AR15 type is a popular weapon which has been used for many years by both the military and civilian population. A very essential part of this firearm is called the bolt carrier assembly and typically the bolt carrier assembly includes a bolt carrier, a bolt mounted in the carrier for axial sliding movement and rotation, a firing pin slidably mounted within the bolt and bolt carrier for restricted reciprocating axial movement, and a cam pin for producing relative rotation between the bolt and the bolt carrier. The bolt carrier is generally cylindrical in shape and is provided with a circular bore throughout its length. The bolt carrier also is provided with an opening on its top and bottom sides to allow the hammer to extend into the interior of the bolt carrier and strike the firing pin. There are also openings to mount a gas key, an opening which serves as a gas receiving port, and an opening to receive the cam pin. About the exterior of the bolt carrier are a series of usually four (4) lands and usually accompanying grooves which extend from the forward end of the bolt carrier (as it is mounted in the firearm) rearwardly for a distance of about one-half the length of the bolt carrier. A land can be defined as a raised portion on the exterior of the bolt carrier which contacts the interior surface of the upper receiver of the firearm. Such lands are generally equally spaced from one another about the exterior of the bolt carrier and are generally parallel to each other. The exterior surface of the lands make contact with the interior surface of the upper receiver of the firearm and serve to align the bolt carrier within the receiver. A firearm of the M16 or AR15 type has the capability of firing a large number rounds of ammunition in a very rapid manner. However, the accuracy of the firearm leaves something to be desired and any improvement in the firearm which tends to increase its accuracy and the smoothness and consistency of operation is very desirable.

SUMMARY OF THE INVENTION

In accordance with my invention there is provided for an automatic or semi-automatic firearm of the AR15 or M16 type having a bolt carrier assembly as previously described, with an improved bolt carrier which can be retrofitted to existing firearms of the M16 or AR15 type without any modification to the receiver of the firearm or any other part thereof. Succinctly stated, the improved bolt carrier can be distinguished from the prior bolt carriers by a substantial increase in the number and area of lands and accompanying grooves in the forward part of the bolt carrier. For example, where a typical bolt carrier is provided with perhaps four lands on its exterior surface, my improved bolt carrier will contain eight or even more such lands. These additional lands give much better alignment of the bolt carrier as it moves in the receiver, more consistent bolt lock-up and generally much smoother operation. Surprisingly, although this substantial increase in the number of lands might be expected to substantially increase the amount of friction within the interior of the receiver, I have noticed no such increase, and even though there may be a slight amount of additional friction, the benefits obtained from the increased number of lands far outweighs the possible increase in friction. Actually, I have found that the additional lands and grooves provides for better lubrication in that there is better retention of the lubricating oil.

DESCRIPTION OF THE PREFERRED EMBODIMENTS

Figure 1:
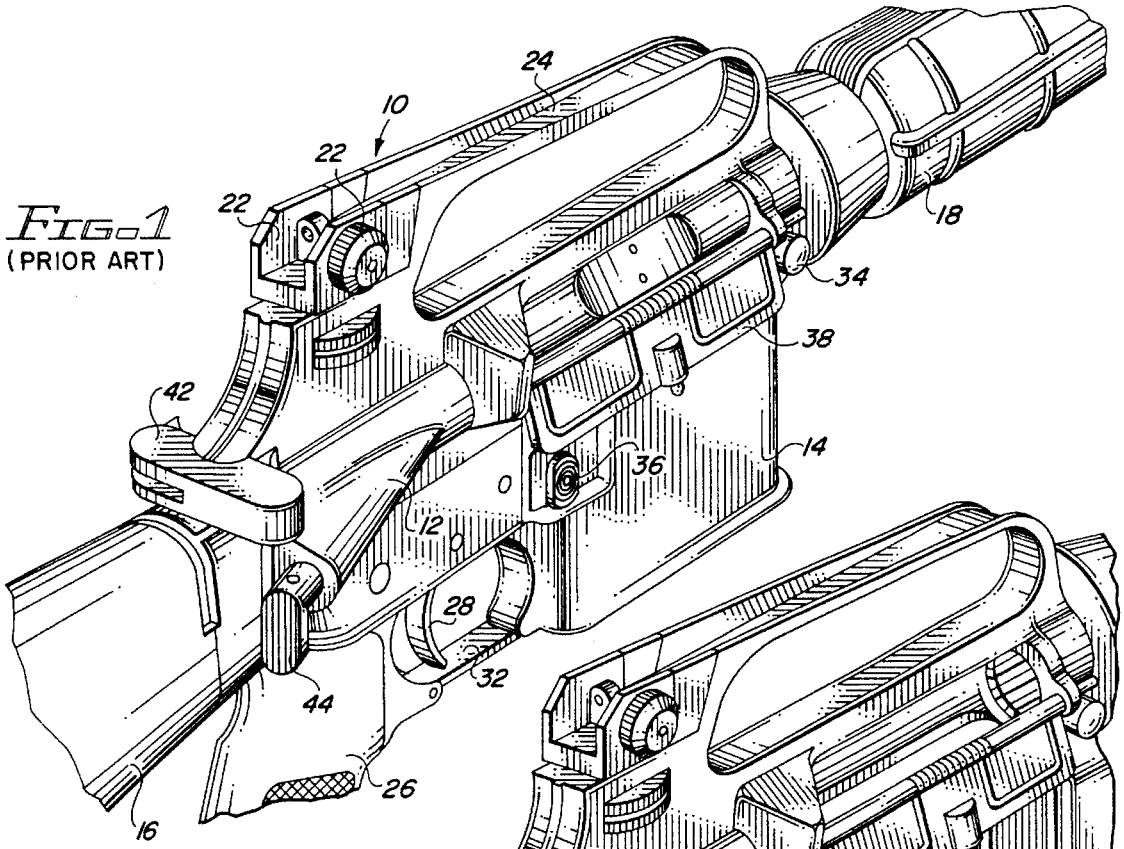
FIG. 1 (PRIOR ART)
FIG. 1 is a partial perspective view of a firearm of the AR15 type.
Figure 2:
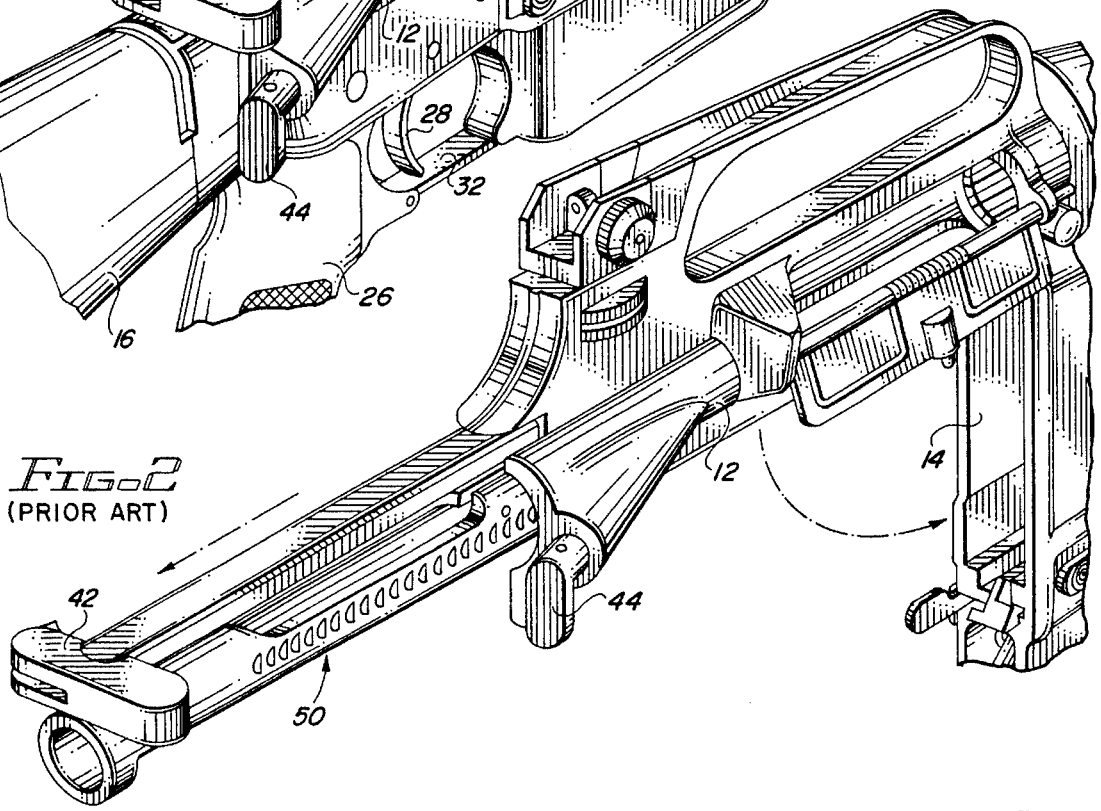
FIG. 2 (PRIOR ART)
FIG. 2 is a partial perspective view of the firearm of FIG. 1 showing a bolt carrier.

Referring to the drawings and more particularly to FIGS. 1 and 2, there is shown in partial perspective at a generally conventional M16 or AR15 type gas operated firearm which can incorporate the improved bolt carrier of this invention. The firearm includes an upper receiver section 12 and lower receiver section 14. Upper receiver section 12 is provided with a chamber (not shown) for receiving a bolt carrier assembly. Firearm 10 also includes butt stock 16, hand guard assembly 18, rear sight assembly 22 and a carrying handle 24. Trigger 28, trigger guard 32 are shown in FIG. 1 along with pistol grip 26. Front hinge 34 is provided to permit the opening of the lower receiver 14 as shown in FIG. 2. A so-called magazine latch button 36 is used to release the magazine (not shown). Charging handle 42 functions to pull the bolt carrier assembly rearwardly when the first round of ammunition is chambered. Thus, pulling on the charging handle picks up a round of ammunition from the magazine and inserts it into the chamber (not shown). The forward assist 44 is used to help to properly place the bolt carrier assembly into the forward battery position if need be. Finally, in the overall view of the firearm an ejection port cover 38 functions during operation of the firearm and opens to allow the ejection of a spent round of ammunition. Its primary function is to keep dirt out of the internal portion of the firearm.

As previously noted, a bolt carrier assembly typically includes a bolt carrier, a bolt mounted in the carrier for axial sliding movement and rotation, a firing pin slidably mounted within the bolt and bolt carrier for restrictive reciprocating axial movement, and a cam pin for producing relative rotation between the bolt and the bolt carrier. FIGS. 3, 5, 7, 9 and 11 show only a prior art bolt carrier 50 without the other structures included in a bolt carrier assembly. FIGS. 4, 6, 8, 10, and 12 show a preferred embodiment of the improved bolt carrier, shown generally at 60, of the invention, again without the other structures of a typical bolt carrier assembly.

Figure 3:
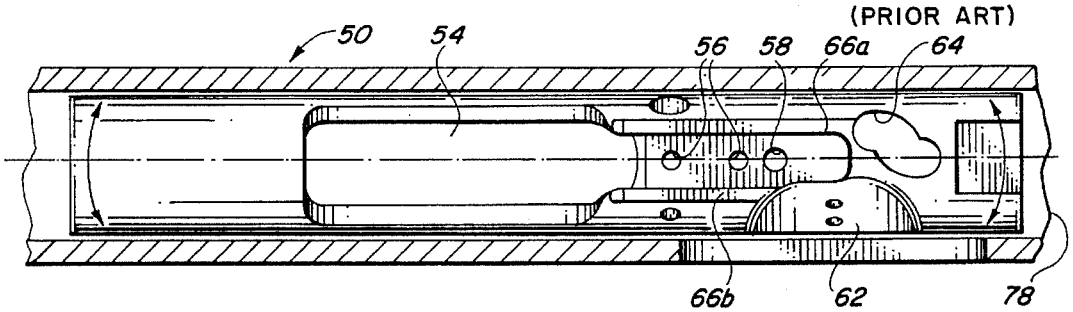
FIG. 3 (PRIOR ART)
FIG. 3 is a top view of a prior art bolt carrier.
Figure 7:
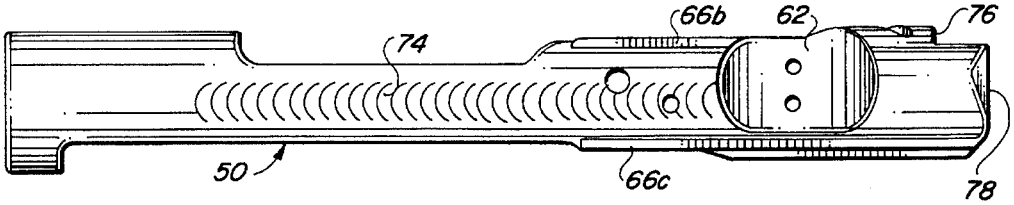
FIG. 7 (PRIOR ART)
FIG. 7 is a side view of the bolt carrier of FIG. 3 wherein the bolt carrier is rotated about 90° from the FIG. 3 view.

As shown in FIGS. 3, 5, 7, 9 and 11 and referring particularly to FIG. 3, a typical prior art bolt carrier 50 includes a hammer clearance slot 54 which permits the hammer to extend into the bolt carrier and strike a firing pin; gas key mounting holes 56; gas port 58; door opener 62 which provides room for the door latch to close; and cam slot 64 which functions to allow the bolt to move rearwardly and rotate axially in the carrier. As shown in FIG. 7, one side of the bolt carrier is provided with forward assist notches 74 which are engaged by the forward assist 44 to help place the bolt carrier assembly to the forward battery position.

Figure 4:
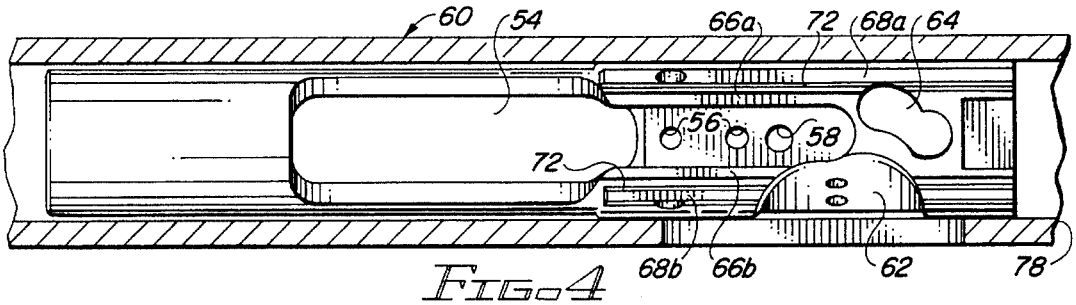
FIG. 4 is a top view of a bolt carrier according to the invention.
Figure 5:
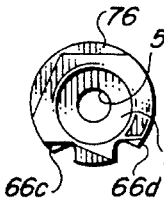
FIG. 5 (PRIOR ART)
FIG. 5 is an end view of the bolt carrier of FIG. 3.
Figure 6:
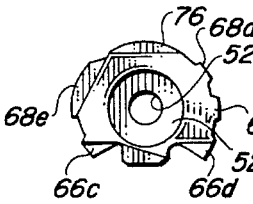
FIG. 6 is an end view of the bolt carrier of FIG. 4.
Figure 8:
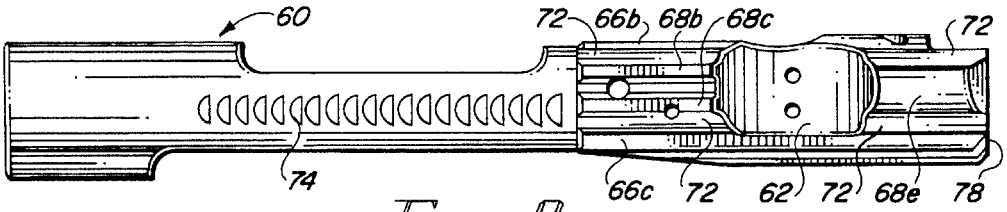
FIG. 8 is a side view of the bolt carrier of FIG. 4 wherein the bolt carrier is rotated about 90° from the FIG. 4 view.
Figure 9:
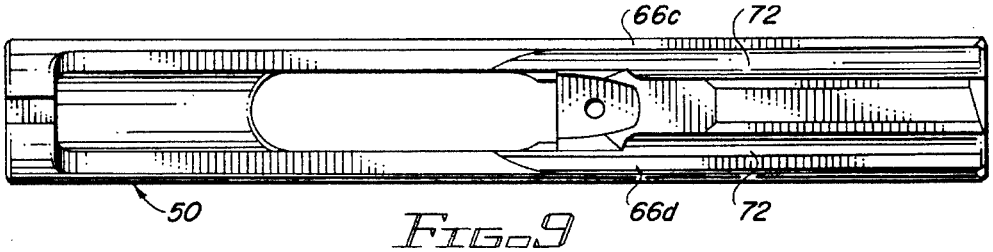
FIG. 9 (PRIOR ART)
FIG. 9 is a bottom view of the bolt carrier of FIG. 3 wherein the bolt carrier is rotated about 180° from the FIG. 3 view.
Figure 10:
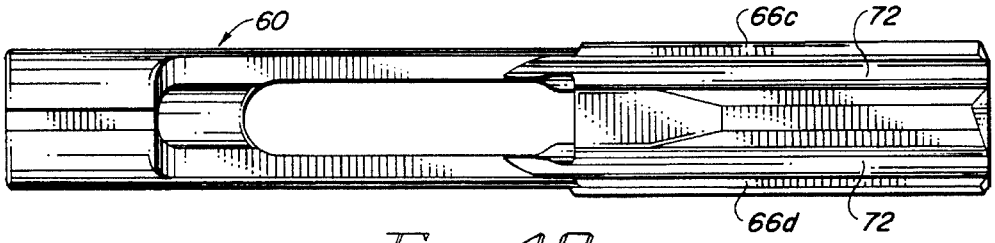
FIG. 10 is a bottom view of the bolt carrier of FIG. 4 wherein the bolt carrier is rotated about 180° from the FIG. 4 view.
Figure 11:
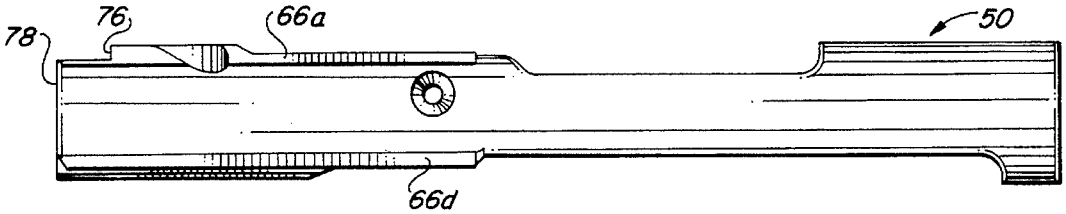
FIG. 11 (PRIOR ART)
FIG. 11 is a side view of the bolt carrier of FIG. 3 wherein the bolt carrier is rotated about 270° from the FIG. 3 view.
Figure 12:
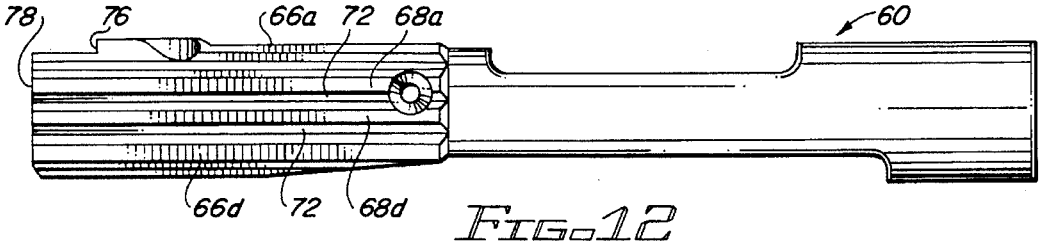
FIG. 12 is a side view of the bolt carrier of FIG. 4 wherein the bolt carrier is rotated about 270° from the FIG. 4 view.

As shown best in FIGS. 5 and 6, a longitudinal bore 52*a* extends from the forward end 78 of the bolt carrier rearwardly for a distance to accommodate the forward portion of the bolt. A smaller bore 52, continues for a further distance to accommodate the tail of the bolt. Additionally, and as best shown in FIGS. 5 and 7, there is a charging handle contact point 76. Thus far, virtually the same construction features are found in the improved bolt carrier of this invention as shown in FIGS. 4, 6, and 8. As shown in FIGS. 3, 5, 7, 9 and 11, the prior art bolt carrier is provided with a series of four (4) lands which extend from the forward end 78 of the bolt carrier rearwardly for a distance of about one-half the length of the bolt carrier. In FIG. 3, two (2) of the lands are shown at 66*a* and 66*b*. The third land 66*c* is shown best in FIG. 7 and the remaining land 66*d* is shown in FIG. 9. The same four (4) lands 66*a*–66*d* are to be found in the improved bolt carrier 60 as shown in FIGS. 4, 6, 8 and 10. However, as shown in FIG. 4, two (2) additional lands 68*a* and 68*b* along with groove 72 are provided in the top portion of the bolt carrier. Additional lands 68*c* and 68*e* are best shown in FIG. 8 along with grooves 72. Land 68*d* is best shown in FIG. 12. As will be understood from the foregoing description and drawings, the invention provides substantially more area of lands on the exterior surface of the forward end portion of the bolt carrier. In a specific example of the invention, in the prior art bolt carrier, the total length of the carrier is 6.675 inches; its diameter at the front end is about 1 inch; and the lands extend a distance of about 2.75 inches from the forward end 78 of the bolt carrier and are about 0.1 inches in width. Thus in the prior art bolt carrier the lands occupy about 16% of the exterior surface of the forward end portion of the bolt carrier. In the improved bolt carrier of the invention, the bolt carrier itself was of the same length and diameter but each of the additional lands 68*a*–*d* were about 0.11 inches in width and of the same length of the lands in the prior art bolt carrier. Land 68*e* was about 0.35 inches by about 0.70 inches. Thus, in the improved bolt carrier, all of the lands occupied about 35% of the exterior surface of the forward end portion Of the bolt carrier. To obtain the benefits of this invention, the lands should constitute at least about 25% to about 50% of the exterior surface of the forward end portion of the bolt carrier, preferably from about 30% to about 40% and most preferred about 35%.

Figure 13:
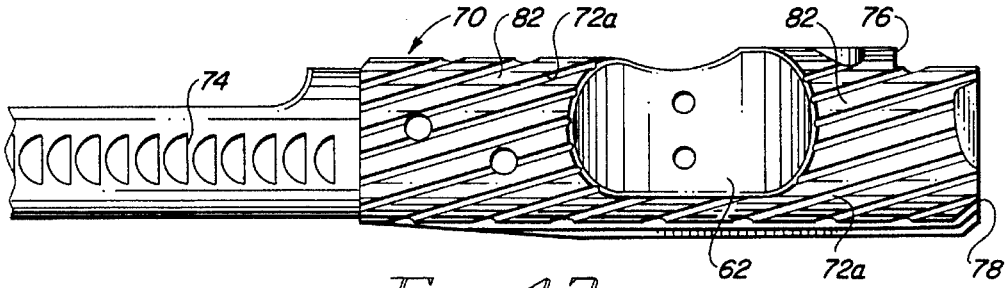
FIGS. 13–15 are side views of further embodiments of the bolt carrier of the invention.
Figure 14:
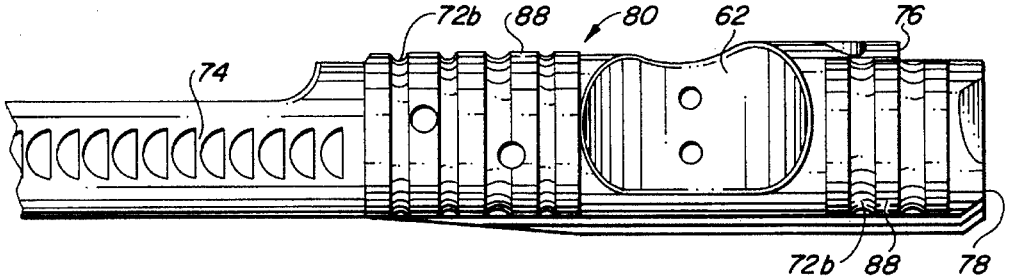
Figure 15:
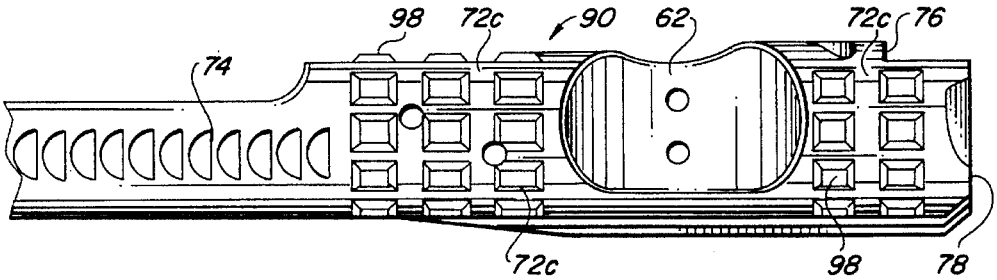

FIGS. 13–15 inclusive show additional embodiments of an improved bolt carrier and in which the side views shown in such Figs. are the same as the side views of FIGS. 7 and 8. As shown in FIG. 13, lands 82 of bolt carrier 70 do not run parallel to the longitudinal axis of the bolt carrier but are positioned at an acute angle to such longitudinal axis; for example, an angle of about 20°. Lands 82 are generally parallel to each other and separated by grooves 72*a*. In FIG. 14, lands 88 of bolt carrier 80 are positioned at about a 90° angle to the longitudinal axis of the bolt carrier. Again, the lands are generally parallel to each other and separated by groove 72*b*. In FIG. 15, lands 98 of bolt carrier 90 are generally rectangular shaped and arranged in a sort of checkerboard pattern on the exterior surface of the forward end of bolt carrier 90. Grooves 72*c* are positioned so that they are on each of the four sides of lands 98.

What is claimed is:

1. A bolt carrier for use in a gas operated firearm, said bolt carrier being in the shape of an elongated cylinder having a forward end as said bolt carrier is positioned in said firearm, said bolt carrier provided with lands separated by grooves about the exterior of its forward end portion, said lands functioning as bearing surfaces and constituting from about 25% to about 50% of the exterior surface of said forward end portion of said bolt carrier, said lands extending no more than one-half of the length of said bolt carrier.

2. The bolt carrier of claim 1 wherein said lands are substantially parallel to the long axis of said bolt carrier.

3. The bolt carrier of claim 2 wherein said lands constitute from about 30% to about 40% of said exterior surface.

4. The bolt carrier of claim 3 wherein said lands constitute about 35% of said exterior surface.

5. The bolt carrier of claim 1 wherein said lands are positioned at an acute angle to the long axis of said bolt carrier and parallel to each other.

6. The bolt carrier of claim 1 wherein said lands are positioned at about a 90° angle to the longitudinal axis of the bolt carrier and parallel to each other.

7. The bolt carrier of claim 1 wherein said lands are generally rectangular in shape, arranged in a checkerboard pattern and with a groove on each side of said lands.

* * * * *